US011306457B2

(12) United States Patent
Pickel

(10) Patent No.: US 11,306,457 B2
(45) Date of Patent: Apr. 19, 2022

(54) SWIMMING POOL COVER TIE-DOWN ANCHORING SYSTEM

(71) Applicant: Jason M. Pickel, Mine Hill, NJ (US)

(72) Inventor: Jason M. Pickel, Mine Hill, NJ (US)

( * ) Notice: Subject to any disclaimer, the term of this patent is extended or adjusted under 35 U.S.C. 154(b) by 160 days.

(21) Appl. No.: 16/891,925

(22) Filed: Jun. 3, 2020

(65) Prior Publication Data

US 2021/0381187 A1 Dec. 9, 2021

(51) Int. Cl.
*E02D 5/80* (2006.01)
*E04H 4/06* (2006.01)

(52) U.S. Cl.
CPC *E02D 5/80* (2013.01); *E04H 4/06* (2013.01)

(58) Field of Classification Search
CPC .. E02D 5/80; E02D 5/801; E04H 4/06; E04H 4/10; E04H 4/108
USPC ..... 4/498, 503, 506
See application file for complete search history.

(56) References Cited

U.S. PATENT DOCUMENTS 2,815,809 A 12/1957 Jacobs et al.
2,958,872 A 11/1960 Meyer, Jr.
3,031,801 A * 5/1962 Leuthesser ..... E04H 4/0075 52/741.12
3,382,628 A * 5/1968 Waite ..... E02D 5/801 52/157
3,967,322 A * 7/1976 Goettl ..... E04H 4/0018 52/169.7
4,014,151 A 3/1977 Erhart
4,471,588 A * 9/1984 Schirm ..... E02D 5/801 52/154
4,916,763 A 4/1990 Christensen
5,014,369 A 5/1991 Daus
5,040,251 A * 8/1991 Hanford ..... E04H 4/144 4/496
6,241,440 B1 6/2001 Orlebeke
9,464,397 B1 * 10/2016 Abraham ..... E02D 5/801
2004/0103599 A1 * 6/2004 Keck ..... E02D 5/801 52/155
2008/0083172 A1 * 4/2008 Tropiano ..... E04C 5/12 52/157
2010/0319272 A1 * 12/2010 Kellner ..... F24S 25/617 52/157
2011/0036025 A1 * 2/2011 Boulay ..... E02D 5/801 52/157
2012/0009022 A1 * 1/2012 Meline ..... E21D 20/025 405/259.1
2019/0390694 A1 12/2019 Green

* cited by examiner

*Primary Examiner* — J C Jacyna
(74) *Attorney, Agent, or Firm* — Thomas J. Germinario

(57) ABSTRACT

A method of anchoring multiple tie-downs of a pool cover of an in-ground swimming pool, which is surrounded by stone or concrete pavers, uses a tubular footing member with multiple flange plates laterally extending along its length. The flange plates include a base flange plate which enclosed the distal end of the footing member and one or more medial flange plates surrounding the tubular circumference of the footing member between its proximal and distal ends. The proximal end of the footing member is open and this proximal opening has interior threading which conjugately mates with the threaded shank of a coupling screw to which a tie-down is anchored.

6 Claims, 3 Drawing Sheets

SWIMMING POOL COVER TIE-DOWN ANCHORING SYSTEM

FIELD OF INVENTION

The present invention relates to the general field of systems for anchoring tie-downs of a swimming pool cover, and more particularly to such systems as applied to in-ground pools surrounded by stone or concrete pavers.

BACKGROUND OF THE INVENTION

Conventional systems for securing tie-downs of in-ground swimming pool covers typically embed the anchors in the material comprising the deck or curbing which surrounds the pool. Such systems have the disadvantage of requiring the replacement of the anchors when the deck or curbing is repaired or replaced. The present invention avoids this problem by providing footings below the deck which pass through apertures in the deck material and reveal threaded openings into which threaded couplers can be screwed.

SUMMARY OF THE INVENTION

The present invention is a method of anchoring multiple tie-downs of a pool cover of an in-ground swimming pool which is surrounded by stone or concrete pavers. The method uses a tubular footing member with multiple flange plates laterally extending along its length. The flange plates include a base flange plate which encloses the distal end of the footing member and one or more medial flange plates surrounding the tubular circumference of the footing member between its proximal and distal ends. The proximal end of the footing member is open and this proximal opening has interior threading which conjugately mates with the threaded shank of a coupling screw. Preferably, the inner circumference of the proximal opening is beveled to match the downward taper of the screw head, so that the coupling screw is countersunk when fully threaded.

Each of the footing members is installed by first lifting one of the pavers to expose the substrate beneath it, which will typically be the sand and/or gravel fill which surrounds the pool. A circular hole is drilled through the paver, with the paver hole circumference slightly greater than the tubular circumference of the footing member, so that the proximal end of the footing member can be snuggly inserted through the paver hole. Next a footing pit is excavated in the substrate below the paver and is filled with poured concrete. The footing member is then set vertically in the footing pit, so that the base flange plate is above the bottom of the pit, and the proximal opening of the footing member extends above the top of the pit by a height equal to the paver depth.

Next the paver is replaced over the footing pit, so that the proximal end of the footing member extends through the paver hole with its proximal opening flush with the top surface of the paver. The coupling screw is then partially threaded into the proximal opening, so that only the screw head extends above the top surface of the paver. After one of the tie-downs is secured to the head of the coupling screw, the coupling screw is further threaded into the proximal opening until the tie-down is flush with the top surface of the paver.

The foregoing process is repeated for each of the tie-downs.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1A:
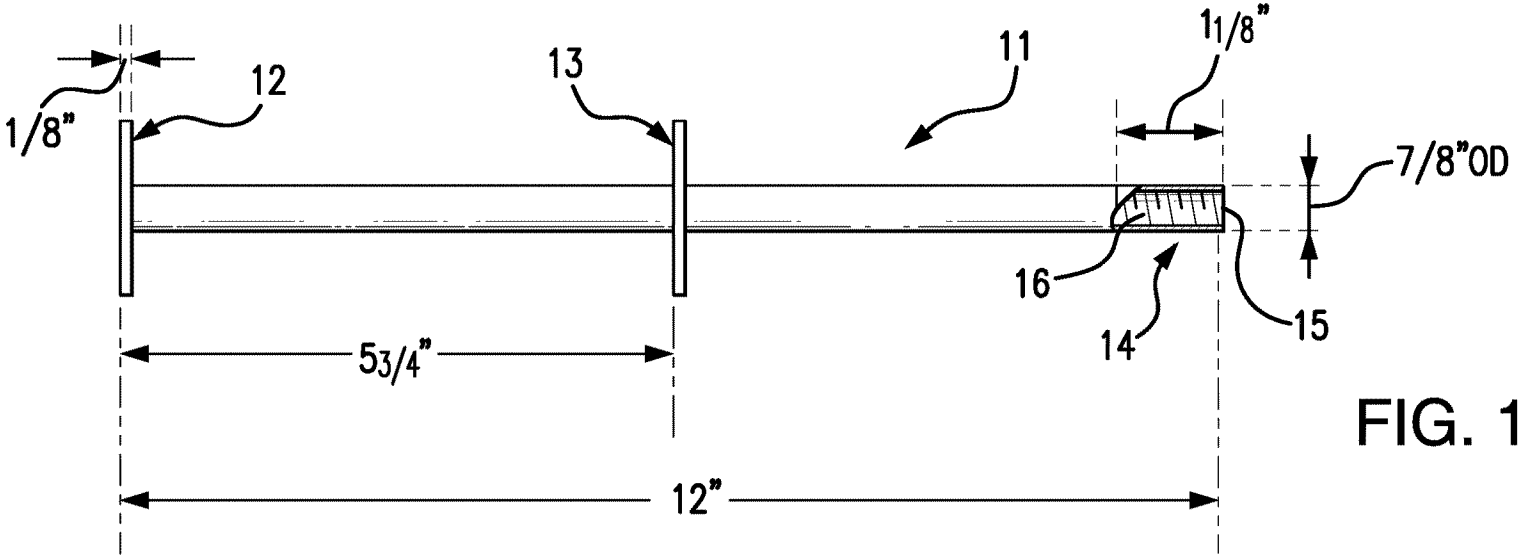
FIGS. 1A-1C are, respectively, side profile, top and bottom views of an exemplary footing member according to one embodiment of the present invention.
Figure 1B:
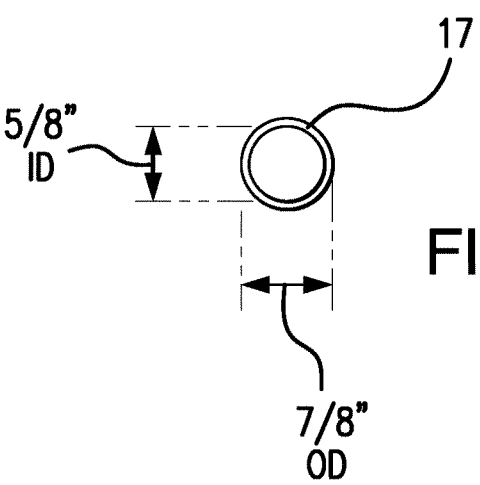
Figure 1C:
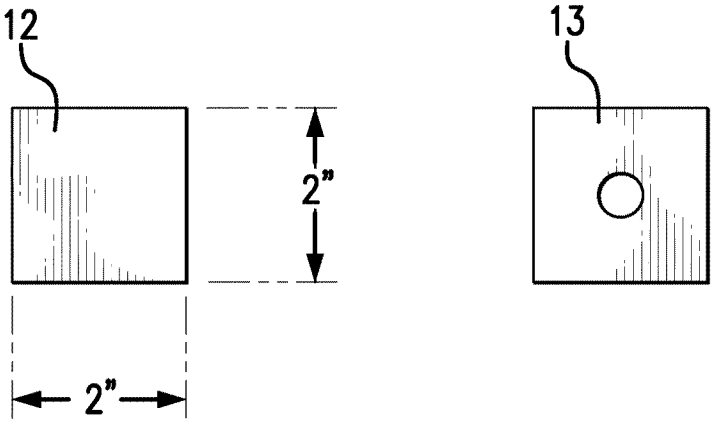

Referring to FIGS. 1A-1C, the exemplary footing member 11 is a tubular structure with two lateral flange plates, consisting of a base flange plate 12 enclosing the distal end and a medial flange plate 13. The proximal end 14 has a proximal opening 15 with interior threading 16. The exemplary footing member is made of ⅞-inch OD schedule 80 black steel pipe with ⅝-inch ID. It is understood that another rust-proof steel material, such as galvanized steel or steel alloy can be substituted for the black pipe. The interior threading 16 of the proximal opening 15 extends to a depth of 1⅛ inch, and the edges of the proximal opening 15 are beveled 17 to match the taper of the head 24 of the coupling screw 23, as best seen in FIG. 3C.

Figure 2:
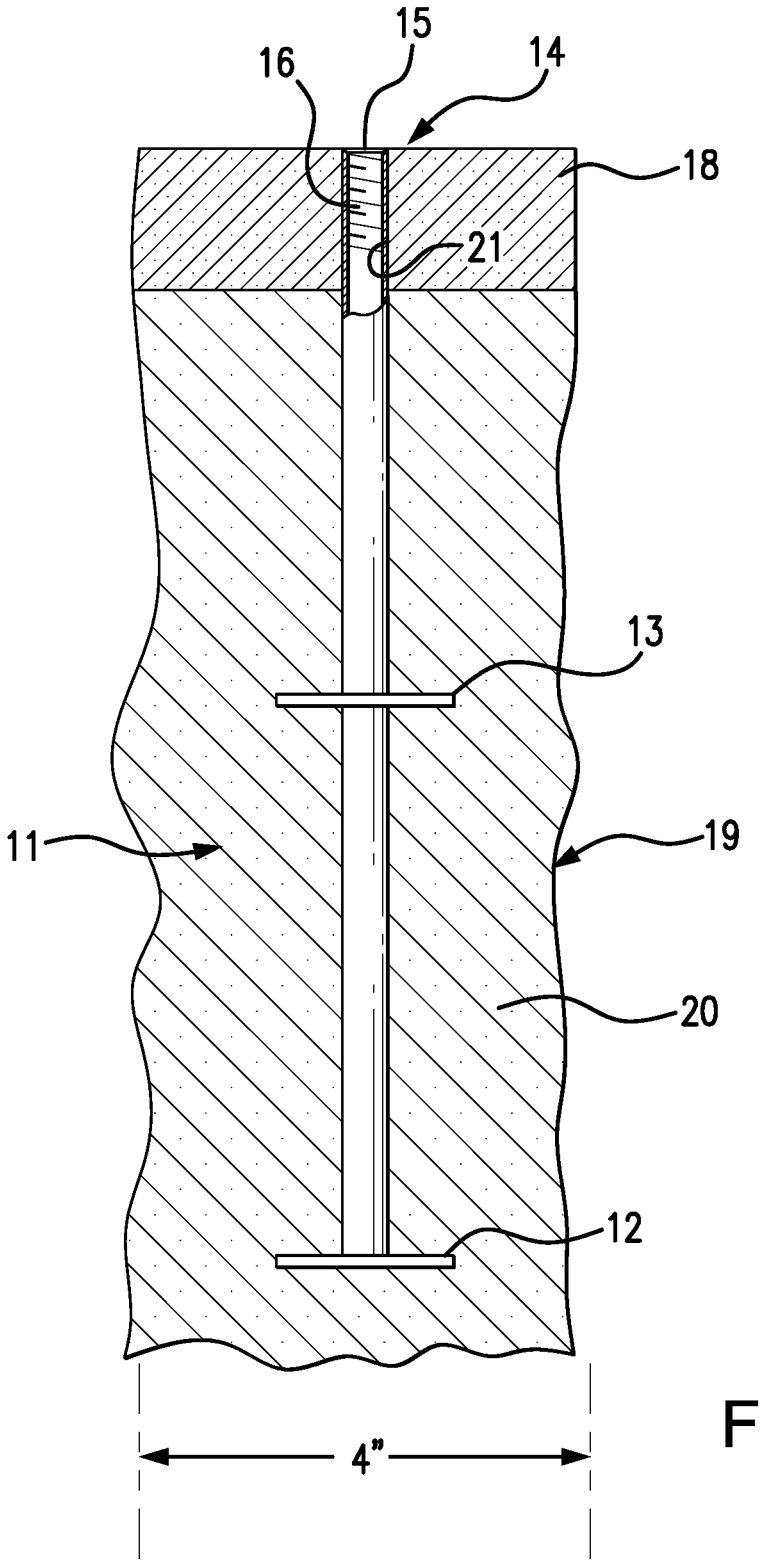
FIG. 2 is a cutaway view of the exemplary footing member set in concrete in a footing pit, with the proximal end of the footing member extending upward through a drilled hole in the paver.

Referring to FIG. 2, the footing member 11 is set vertically upright in concrete 20 filling the footing pit 19 excavated in the substrate of the paver 18, with the proximal end 14 extending through a drilled paver hole 21 and with the proximal opening 15 flush with the top surface of the paver 18.

Figure 3A:
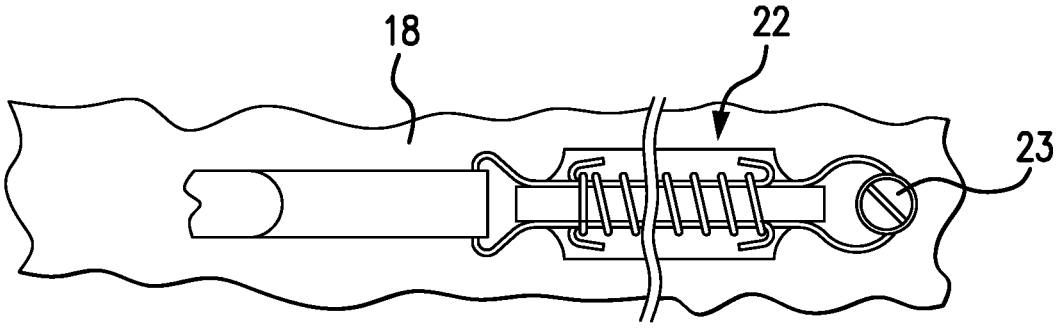
FIGS. 3A and 3B are top and side views, respectively, of a typical pool cover tie-down (in ghost view) secured to a coupling screw threaded into the proximal opening of the exemplary footing member.
Figure 3B:
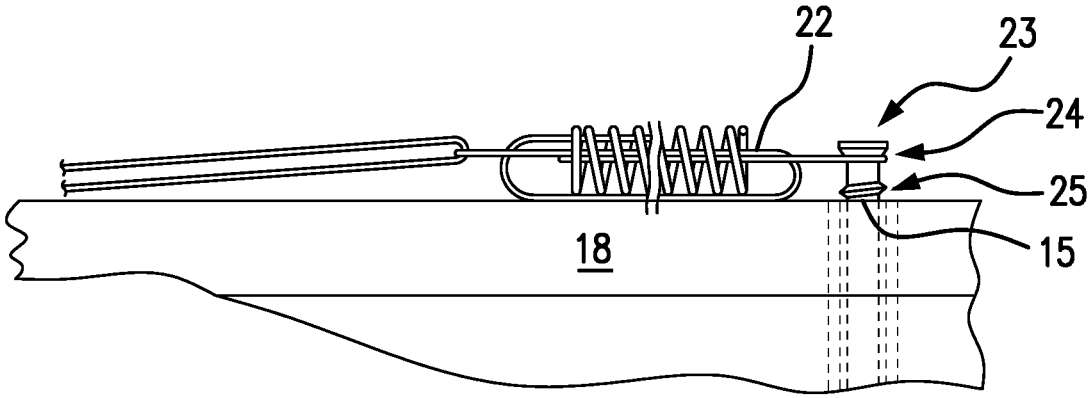
Figure 3C:
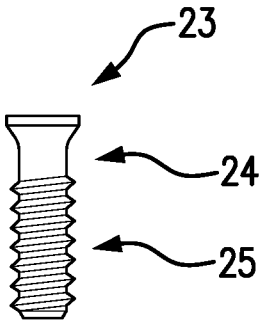
FIG. 3C is a detail side profile view of the coupling screw depicted in FIGS. 3A and 3B.

Referring to FIGS. 3A-3C, a typical pool cover tie-down 22 is shown secured to the head 24 of the coupling screw 23, which is then fully threaded 25 into the proximal opening 15 until the tie-down 22 is flush with the top surface of the paver 18.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A method of anchoring multiple tie-downs of a swimming pool cover which is surrounded by stone or concrete pavers, the method comprising the steps:

(a) providing a rigid elongated tubular footing member having an exterior circumference and an interior circumference, and having a proximal end and a distal end, and having a midpoint equidistant between the proximal end and the distal end, wherein the footing member has multiple flange plates comprising one or more medial flange plates, which laterally surround the exterior circumference between the proximal end and the distal end, and a base flange plate that laterally extends from and encloses the distal end, and wherein the proximal end has a proximal opening with interior threading;

(b) providing a coupling screw having a head section and a threaded section, wherein the threaded section conjugately mates with the interior threading of the proximal opening of the tubular structure;

(c) lifting one of the pavers so as to expose a paver substrate;

(d) drilling a circular paver hole through the paver, wherein the paver has a top surface and a bottom surface, which are separated by a paver depth, and wherein the paver hole has a circumference slightly greater than the exterior circumference of the footing member;

(e) excavating a footing pit in the paver substrate, wherein the footing pit has a pit top and a pit bottom;

(f) filling the footing pit with poured concrete;

(g) setting the footing member vertically in the footing pit, so that the base flange plate is above the pit bottom, and the proximal end of the footing member extends above the pit top by a reveal height equal to the paver depth;

(h) replacing the paver over the footing pit, so that the proximal end of the footing member extends through the paver hole, with the proximal opening aligned with the top surface of the paver;

(i) partially threading the coupling screw into the proximal opening of the footing member, so that only the head section extends above the top surface of the paver;

(j) securing one of the tie downs to the head section of the coupling screw; and (k) further threading the coupling screw into the proximal opening of the footing member, so that the tie-down is flush with the top surface of the paver; and (l) repeating steps (a)-(k) for each of the tie-downs.

2. The method according to claim 1, wherein there is one medial flange plate, and wherein the medial flange plate is located between the midpoint and the distal end of the footing member.

3. The method according to claim 2, wherein the proximal opening of the footing member has a beveled edge, and wherein the head section of the coupling screw is downwardly tapered so as to countersink in the proximal opening.

4. The method according to claim 3, wherein the footing member comprises a rust-proof steel or steel alloy pipe and the flange plates that are square or rectangular plates fabricated from rust-proof rolled steel.

5. The method according to claim 4, wherein the pipe has a length of 10 to 18 inches and an exterior diameter of ¾ to 1 inch and an interior diameter of ½ to ¾ inch.

6. The method according to claim 5, wherein the pipe is ¾ inch schedule 80 black pipe and the interior threading at the proximal end has a depth of 1⅛ inches.

* * * * *